United States Patent [19]

Rose

[11] Patent Number: 4,903,454

[45] Date of Patent: Feb. 27, 1990

[54] BUILDING CLADDING SYSTEM

[76] Inventor: Stephen L. Rose, The Cottage, Schoolhouse Lane, Abbots Bromley, Nr. Rugeley, United Kingdom, WS15 3BT

[21] Appl. No.: 231,378

[22] Filed: Aug. 11, 1988

[30] Foreign Application Priority Data

Aug. 13, 1987 [GB] United Kingdom ..... 8719178

[51] Int. Cl.[4] ..... E04B 2/00

[52] U.S. Cl. ..... 52/766; 52/235

[58] Field of Search ..... 52/235, 766, 767, 127.11

[56] References Cited

U.S. PATENT DOCUMENTS

| | | | |
|---|---|---|---|
| Re. 17,706 | 6/1930 | Nelson | 52/767 |
| 2,121,094 | 6/1938 | Nuding et al. | 52/767 X |
| 3,266,207 | 8/1966 | Birum, Jr. | 52/235 X |
| 3,530,633 | 9/1970 | Scott | 52/235 X |
| 3,885,367 | 5/1975 | Thunberg | 52/204 |
| 3,978,629 | 9/1976 | Echols, Sr. | 52/235 |
| 4,074,486 | 2/1978 | Grearson | 52/235 |
| 4,672,784 | 6/1987 | Pohlar | 52/235 |

FOREIGN PATENT DOCUMENTS

| | | |
|---|---|---|
| 0060007 | 9/1982 | European Pat. Off. . |
| 0115730 | 8/1984 | European Pat. Off. . |
| 2133314 | 1/1973 | Fed. Rep. of Germany . |
| 1300846 | 7/1962 | France . |
| 796176 | 6/1958 | United Kingdom . |
| 1072595 | 6/1967 | United Kingdom . |
| 1350942 | 4/1974 | United Kingdom . |
| 1382170 | 1/1975 | United Kingdom . |

*Primary Examiner*—David A. Scherbel
*Assistant Examiner*—Anthony W. Williams
*Attorney, Agent, or Firm*—Spensley Horn Jubas & Lubitz

[57] ABSTRACT

A building cladding system comprising an infill panel mounted on frame members wherein at least one frame member has an outwardly facing abutment part against which an inwardly facing part of the infill panel is clamped by a clamping member, operating means to move the clamping member into clamping engagement with the infill panel and said means being accessible from a driving position inwardly of the panel.

13 Claims, 6 Drawing Sheets

BUILDING CLADDING SYSTEM

DESCRIPTION OF INVENTION.

This invention relates to a building cladding system comprising an infill member mounted on frame members.

An object of the invention is to provide a new and improved building cladding system.

According to the present invention we provide a building cladding system comprising an infill panel mounted on frame members wherein at least one frame member has an outwardly facing abutment part against which an inwardly facing part of the infill panel is clamped by a clamping member, operating means to move the clamping member into clamping engagement with the infill panel and said means being accessible from a driving position disposed inwardly of the panel.

Said operating means to move the clamping member may comprise a first member extending inwardly from the clamping member to an intermediate position disposed inwardly of the panel and operatively engaged with means extending from the intermediate position to said driving position whereby the first member may be driven, from said driving position, to move the clamping member into clamping engagement with the infill.

Said means extending from the intermediate position to said driving position may comprise a second member which extends laterally of the first member.

The first and second members may be operatively connected by a cam surface associated with one member and a cam follower associated with the other member.

The cam surface may comprise an inclined plane moveable by the second member and engaged by a cam follower connected to the first member.

The cam surface may be movable in a direction generally parallel to the infill panel and the cam follower may be moveable in a direction generally perpendicular to the infill panel.

The cam surface may be mounted on a transom and/or mullion and be moveable longitudinally thereof by the second member which may be moveable longitudinally thereof.

The first member may have a part which extends within an associated mullion or transom for engagement with the second member.

At least one frame member may have at least part of said outwardly facing abutment part removably attached to the remainder of the frame member and the frame member may comprise a transom and the transom may support the bottom edge of the panel.

Opposed upright frame members may have opposed transversely facing abutment parts which are spaced so as to permit of the infill panel being manoeuvred part associated outwardly facing abutment parts of the upright members.

Figure 1:
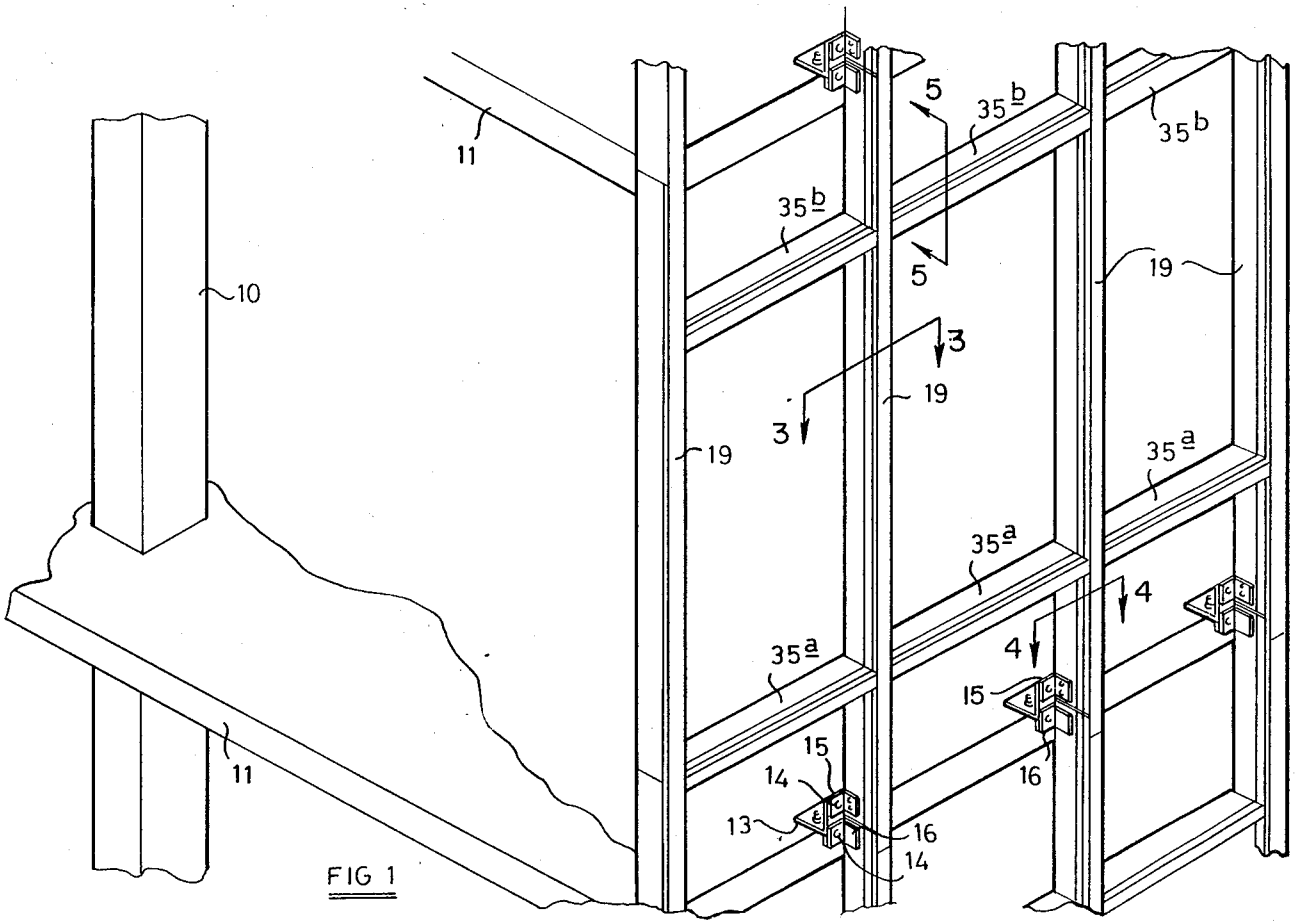
Figure 2:
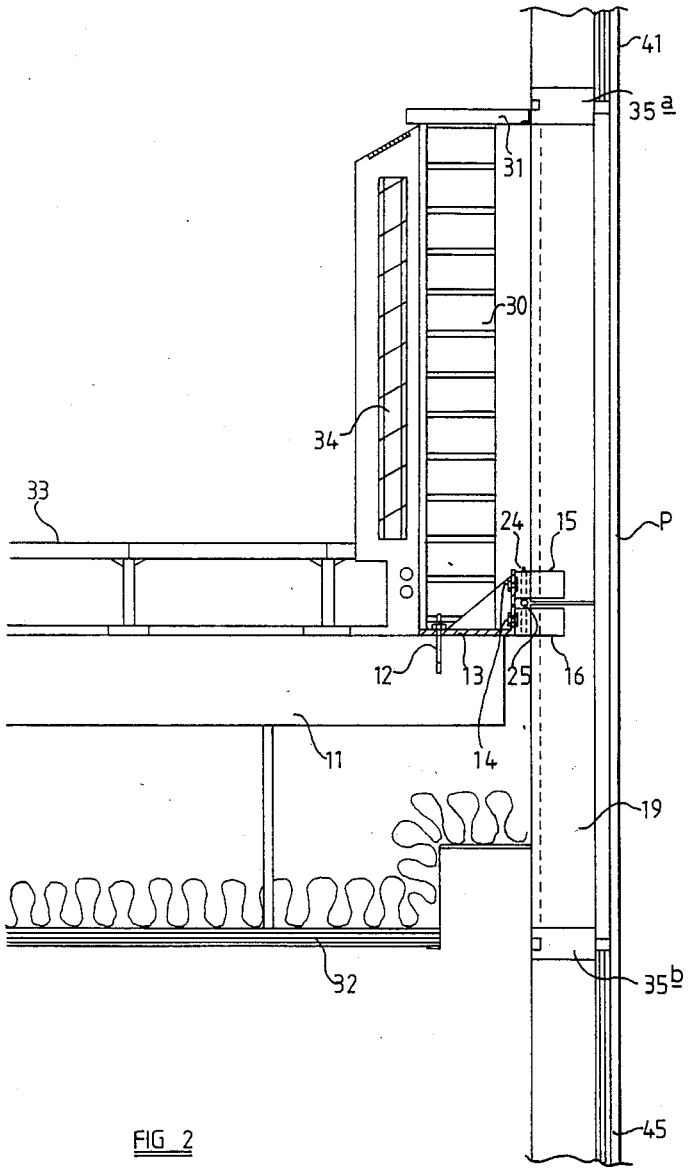
Figure 3:
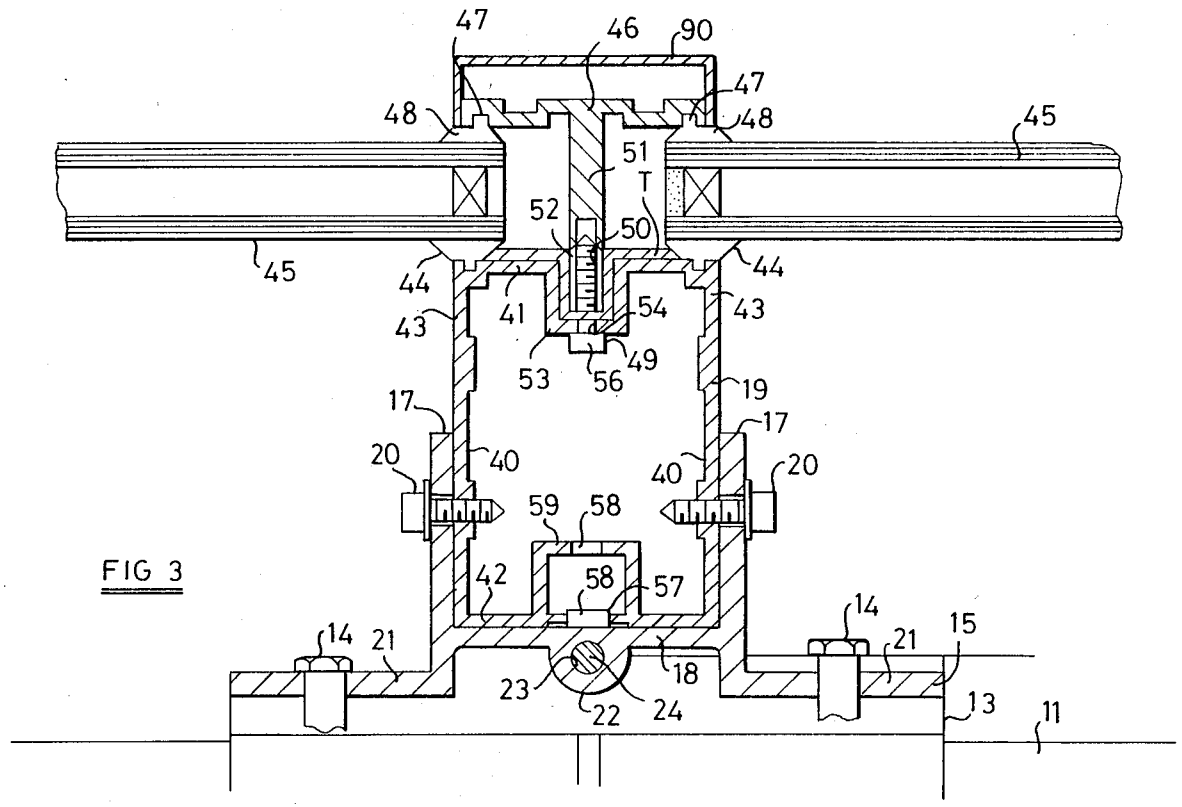
Figure 4:
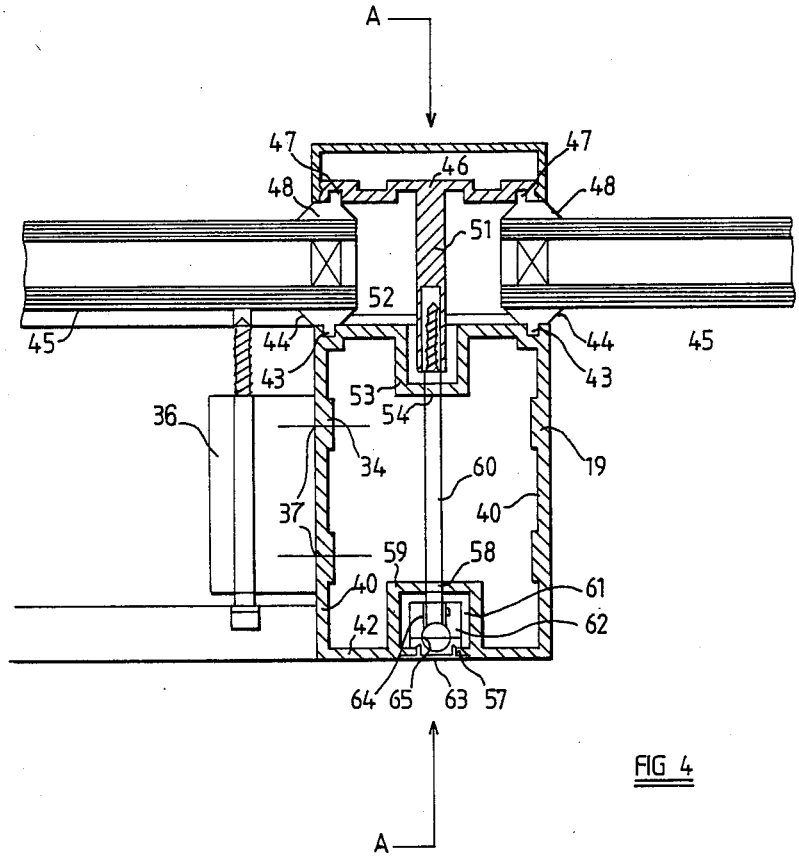
Figure 5:
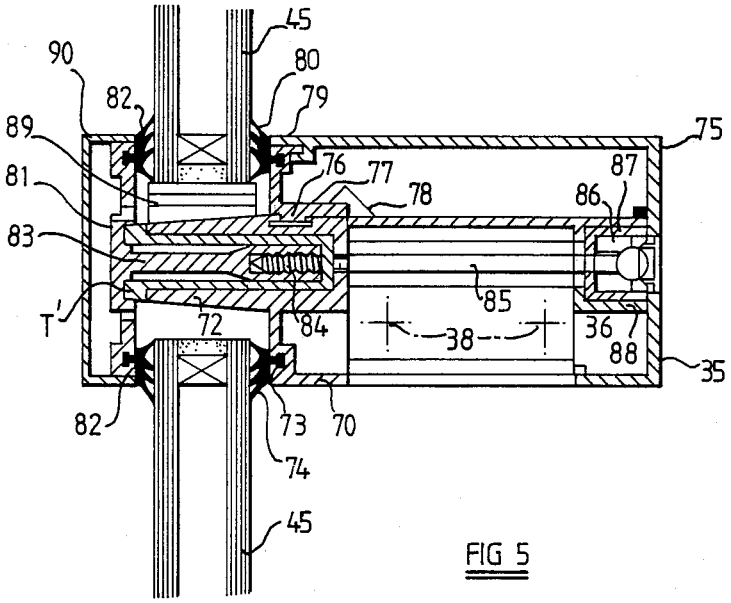
Figure 6A:
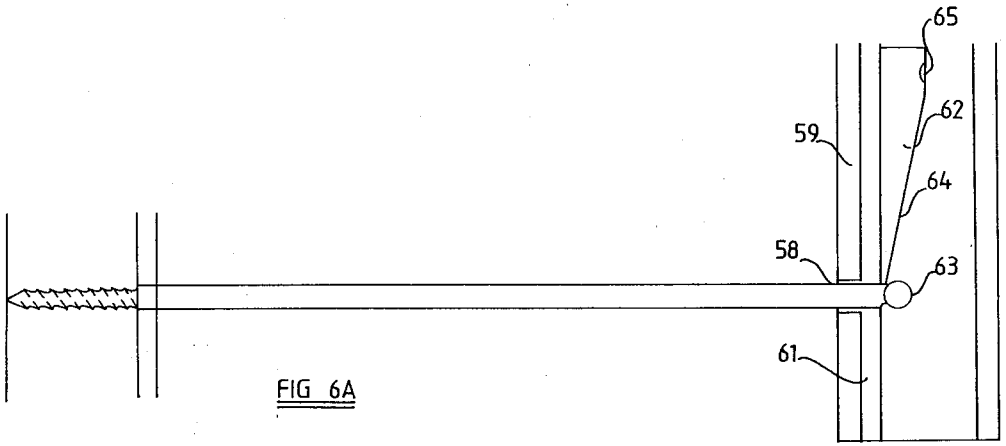
Figure 6B:
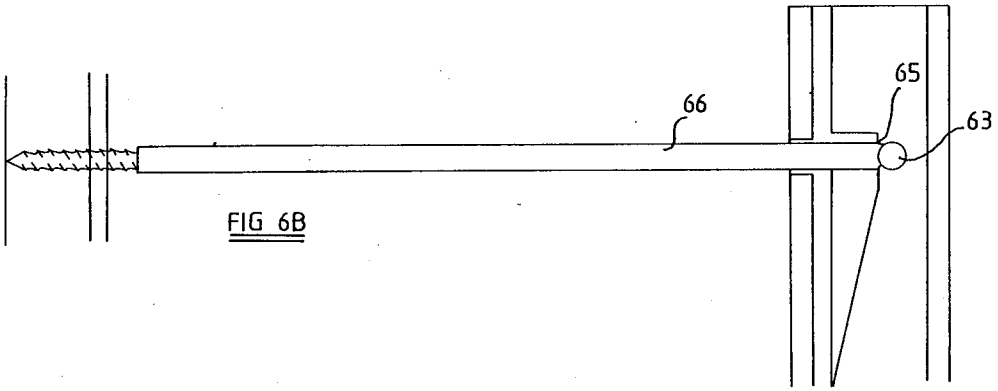

An embodiment of the invention will now be described in more detail by way of example with reference to the accompanying drawings wherein;

FIG. 1 is a fragmentary perspective view of part of a building clad with a building cladding system embodying the invention, FIG. 2 is a fragmentary vertical section through part of the building of FIG. 1, FIG. 3 is a transverse cross-section through part of a mullion of the building of FIG. 1, FIG. 4 is a transverse cross-section through another part of a mullion of the building of FIG. 1, FIG. 5 is a transverse cross-section through a transom of the building of FIG. 1, and FIG. 6 is a diagramatic illustration of an operating means employed in the building of FIG. 1.

Referring to FIG. 1 of the drawings, part of a building is illustrated comprising vertical structural columns 10 of conventional construction such as steel or concrete supporting a plurality of floor slabs 11 likewise of conventional construction, for example, concrete. Fixed by rag bolts 12 to the floor slabs 11 are angle brackets 13 to which are fastened, by bolts 14, a pair of mullion cleats 15, 16.

Referring now particularly to FIGS. 2 and 3 each mullion fixing cleat 15, 16 comprises a channel part defined between spaced parallel limbs 17 and a base 18. A mullion 19 of generally rectangular cross-section is received within the channel and is secured to the limbs 17 by fixing bolts 20. The limbs 17 have outwardly extending flanges 21 which receive the bolts 14 for clamping to the bracket 13. The base 18 has a generally half cylindrical projection or rib 22 having an internally threaded bore 23. An adjusting ball screw 24 is threadedly received within the bore 23 of the upper, 15, of each pair of mullion cleats 15, 16 and its ball end 25 bears on the upper end of the bore 23 in the lower mullion cleat 16. Thus, by rotating the screw 24, the relative spacing between the pair of mullion cleats 15, 16 can be adjusted during assembly of the building prior to tightening of the bolts 14 to the bracket 13. The holes for the bolts 14 in the bracket 13 and/or the limbs 15 are formed, for example by being elongated in the vertical direction, to permit such adjustment.

In the present example an upstand wall 30 is built in brick on the floor slab 11 and extends over a part of the height of each storey and is capped by a window sill 31. The floor slab 11 in the present example is provided with a suspending ceiling 32 and a suspended floor 33. The wall 30 in the present example carries a radiator 34. It should be appreciated that the wall 30 may be made of other material can be of different height and of course need not carry a radiator and neither need the floor slab be provided with a suspended floor and/or ceiling.

Extending horizontally between the mullions 19 are transoms 35*a, b*. In the present example the transoms 35*a, b* are positioned, as shown, so that one (35*a*) is spaced relatively closely above and another (35*b*) relatively closely below each floor slab 11 so that an opaque infill or cladding panel P can be received between the pair of transoms 35*a, b* positioned on opposite sides of an associated floor slab 11 whilst a glass glazing infill panel 45 can be received between the pair of transoms 35*a, b* which are positioned between adjacent floor slabs 11. The transoms 35*a, b* are positioned so that the opaque panel P obscures the upstand wall 30, floor slab 11 and space above the suspened ceiling 32.

As best shown in FIGS. 4 and 5 at the vertical position of transom 35*a, b* a transom cleat 36 is bolted to each mullion 19 at 37 whilst the cleat 36 is bolted to the transom 35*a, b* as shown at 38. As shown in FIGS. 3 and 4 each mullion is of generally rectangular box configuration having spaced parallel side walls 40 and spaced parallel front and rear walls 41, 42 respectively. The front wall 41 is provided with a pair of longitudinally extending recesses 43 which receive sealing strips 44 of conventional configuration which sealingly engage a cladding infill panel such as a double glazing unit 45. The infill panels 45 are clamped to the mullion by means of a pressure bar 46 of generally T shape in cross-section and having a pair of longitudinally extending grooves 47 to receive sealing strips 48 similar to the sealing strips 44 and which are held in sealing engagement with the panels 45 by the pressure bar 46. The force exerted by the pressure bar 46 through the sealing strips 48 maintains the infill panels in position.

At a level above the upstand wall 30 the pressure bar 46 is urged into clamping engagement with the panels 45 by means of a bolt 49 received in a screw threaded bore 50 in the end of a stem part 51 of the pressure bar 46. The bolt 49 passes through a longitudinally extending slot 52 in the front wall 41 which is bridged by a channel formation 53 formed on the internal surface of the front wall 41.

The base of the channel formation 53 is provided with discrete apertures 54 through which the bolts 49 pass.

The heads 56 of the bolts 49 are accessible from the interior of the building through a longitudinally extending slot 57 formed in the rear wall 42, which is bridged by a channel formation 59, formed on the internal surface of the rear wall 42. The base of the channel formation 59 is provided with discrete apertures 58 at the appropriate position for each bolt 49.

The slot 57 is closed in the region of the mullion fixing cleats by a nose provided on the mullion fixing cleats and by a suitable closure member of plastics or aluminium at positions spaced from the mullion fixing cleats.

A thermal break insulating member T of suitable material is provided between the stem 51 and the interior of the channel formation 53.

Referring now to FIG. 4, at positions behind the upstand wall 30 where access cannot be gained to permit use of bolts 49 ball headed screw members 60 are engaged with the stem part 51 of the pressure bar 46 and project through slot 52, aperture 54 and aperture 58 into the interior of the channel formation 59. Longitudinally slidably mounted within the channel 59 is a channel member 61 having fixed thereto a plurality (corresponding to the member of screw members 60) of riser blocks 62 of suitable plastics material such as nylon. The riser blocks 62 have an inclined cam surface 64 at the higher end of which is provided a detent recess 65 which receives the ball head 63 when the assembly is in its securing position hereinafter to be described.

When the infill panel 45 is in its in use position, the channel 61 extends upwardly and downwardly to positions generally midway between adjacent pairs of transoms 35*a, b* and access to the channel 61 to move the channel downwardly as hereinafter described, to secure the panel, is achieved from above, after removing the appropriate closure member along the channel 57 above wall 30. To move the channel 61 in an opposite direction i.e. upwardly, to enable a panel 45 to be replaced for example, access to the channel 61 is achieved from below, again after removing the appropriate closure member between the ceiling 32 and above the wall 30 of the floor below.

Referring now to FIG. 5, each transom 35*a, b* comprises a generally rectangular elongate box section member 70 having at one end a projecting nose part 72 on the top of which an infill panel 45 is supported. The box section part 70 is provided with a longitudinally extending groove 73, similar to the grooves 43 of the mullions, in which is received a sealing strip 74 similar to the sealing strips 44. At the top of the box section part 70 is provided a glazing bead 75 which is retained on the part 70 by engagement of tongue parts 76 in recesses 77 of the part 70. A mastic seal 78 is provided between the glazing bead 75 and the part 70 and the glazing bead 75 has a groove 79 to mount a sealing strip 80 similar to the sealing strip 74.

Infill panels 45 are clamped against the sealing strips 74, 80 by a pressure bar 81 similar to the pressure bar 46 as hereinbefore described and carrying sealing strips 82. The stem 83 of the pressure bar 81 receives, in a threaded bore 84, one end of ball screws 85 which engage plastic riser blocks 86 carried in a channel 87 which is slidable longitudinally within a channel formation 88, all similar to the corresponding parts of the mullion. Spacer blocks 89 are provided beneath the infill panel 45 which is supported on the nose part 72. A thermal break insulator T′ of suitable synthetic plastics material is provided between the pressure bar 81 and its stem 83 and the nose part 72 in a similar manner to the thermal insulator T provided on the mullions. A cover cap 90 is clipped to the pressure bars 46, 81.

To erect the cladding, initially the transoms 35*b* below the floor slabs 11 are secured to their associated mullions and have the glazing beads 75 mounted thereon. The bolts 49 are slackened so that the pressure bar 46 is spaced away from the front surface 41 of the mullions with clearance for the panels 45 to be used on the channels 61 of the mullions are in the position shown in FIG. 6A so that the pressure bar 46 is also in such a spaced position in regions longitudinally of the mullions aligned with the upstand wall 30. Similarly, the sliding channel 87 of the transoms is moved in a direction so that the ball head of the screw 85 is at the lower end of the rising blocks so that the clamping bar 81 of the transom is similarly well spaced from the front surface of the part 70.

A cladding panel P is then offered up to its aperture defined by the transom 35*b* and a pair of mullions by offering a first vertical side of the panel into the recess afforded between the pressure bar 46 and front surface 41 of one of the mullions to give room for the opposite vertical side of the panel to move past the other mullion. The panel is then centralized so that opposite edge portions are received in the recesses of adjacent mullions between the pressure bar 46 and respective front surface 41.

At the same time the panel is dropped into the corresponding space of the transom 35*b*.

A transom 35*a* at the level of the top of the wall 30 is then fastened between its mullions by transom cleats 36 so that the top edge of the panel P is received in the recess between the clamping bar 81 and the box section 70 below the nose part 72. The transoms 35*a* at this level have the glazing beads 75 removed so that said infill panels 45 can be manoeuvred into position, as described above, beneath the transom next above, i.e. the transom 35*b* below the next above floor slab and then, when centralized between the mullions, the panel 45 is raised and the spacer blocks 89 inserted so that the top edge of the panel 45 is received in the recess between the clamping bar 81 and the box section 70 below the nose part 72 of the transom 35*b*. The glazing bead 75 is then engaged with the transom 35*a*.

The channels 61 of the mullions are then pushed downwardly in any convenient manner to cause the heads 63 of the screws 60 to move along the riser block 64 until they are received in the detent recesses 65 and so clamp the pressure bars 46 against the panels. Similarly, the channel 87 of the transom is slid to cause the pressure bar 83 thereof to be moved into clamping engagement with the panels.

In this example the pressure bars above the wall 30 are clamped into position using the screws 49 and similar screws 49 may be provided on the transoms. Of course, if desired, sliding channels and riser blocks together with ball headed screws may be used throughout the cladding system if desired.

Removal of the panels, for example, to replace a glazing or an opaque panel is essentially the reverse of the above described operation.

Although in the above described example the glazing panels have been shown as double glazed panels in which the inner sheets are engaged by an outwardly facing abutment part of the mullion and transom (provided by the seals 44 and 73, 80 respectively) and the outer sheets are engaged by a clamping member (provided by the pressure bar 46). If desired the infill panel may be of any other desired type and may, for example, have a peripheral frame in which an infill sheet or sheets is or are mounted, the frame being engaged by the outwardly facing abutment part and/or clamping member.

The features disclosed in the foregoing description, or the accompanying drawing, expresses in their specific forms or in terms of a means for performing the disclosed function, or a metal or process for attaining the disclosed result, or a class or group of substances or compositions, as appropriate, may, separately or any combination of such features, be utilize for realizing the invention in diverse forms thereof.

I claim:

1. A building cladding system comprising:

an infill panel having an inwardly facing peripheral portion, a plurality of frame members provided by elongate mullions and transoms, an outwardly facing abutment provided on at least one of said frame members, a clamping member, and operating means for moving said clamping member into clamping engagement with said infill panel to clamp said inwardly facing portion of said infill panel against said outwardly facing abutment, said operating means comprising:

a first member extending inwardly from said clamping member to an intermediate position disposed inwardly of said panel, an elongate second member extending laterally relative to said first member, means mounting said second member on said at least one frame member for sliding movement longitudinally thereof, and inter-engageable cam elements including a first cam element associated with said second member and a second cam element associated with said first member operably to interengage said first and second members at said intermediate position, wherein said second member extends from said intermediate position to a driving position disposed remotely from said intermediate position and accessible from a position disposed inwardly of said panel, and said second member is engageable at said driving position so as to be slidable longitudinally of said at least one frame member to cause sliding movement of said first cam element associated with said second member, parallel to said infill panel and longitudinally of said at least one frame member, and to cause movement of said second cam element associated with said first member, in a direction generally perpendicular to said infill panel, to move said clamping member into clamping engagement with said infill panel.

2. A system according to claim 1 wherein said first cam element comprises a cam surface provided by said second member and said second cam element comprises a cam follower provided by said first member, said cam surface providing detent means to maintain said clamping member in said clamping engagement with said infill panel.

3. A system according to claim 1 wherein said first member extends from said clamping member through said at least one frame member to said intermediate position.

4. A system according to claim 3 wherein said at least one frame member has a rearwardly facing surface provided with a channel and said second member is slidably mounted in said channel.

5. A system according to claim 4 wherein: said at least one frame member has a forwardly facing surface provided with an opening; said rearwardly facing surface of said one frame member is provided with an opening; and said first member extends through said openings in said frame member surfaces to engage with said second member.

6. A system according to claim 1 wherein said second member is provided with a plurality of cam elements at spaced positions longitudinally thereof.

7. A system according to claim 6 wherein said second member is slidably mounted on a said frame member which is a mullion and extends upwardly and downwardly to positions generally midway between adjacent pairs of transoms.

8. A system according to claim 1 further comprising an upstand wall disposed inwardly of said at least one frame member, and wherein said second member extends from a said cam element disposed at a position between said wall and said infill panel to said driving position which is disposed beyond said wall, whereat driving access may be gained to said second member.

9. A system according to claim 1 wherein at least one of said frame members comprises a main part and at least part of said outwardly facing abutment is removably attached to said main part.

10. A system according to claim 9 wherein said at least one frame member having said abutment removably attached thereto is a transom.

11. A system according to claim 10 wherein said transom supports the bottom edge of said infill panel.

12. A system according to claim 1 wherein: two of said frame members are mullions which are opposed to one another, said system further comprises transversely facing abutments each provided on a respective one of said two frame members so that said transversely facing abutments are opposed to one another; each of said two frame members is provided with a respective outwardly facing abutment; and said transversely facing abutments on said two frame members are spaced apart to permit said infill panel to be maneuvered past said outwardly facing abutments of said two frame members.

13. A building when clad with a building cladding system according to claim 1.

* * * * *